United States Patent [19]

Matsueda et al.

[11] 4,119,823

[45] Oct. 10, 1978

[54] ELECTRICAL SWITCH

[75] Inventors: Kenichi Matsueda; Takao Kitamura, both of Kurayoshi, Japan

[73] Assignee: Omron Tateisi Electronics Co., Japan

[21] Appl. No.: 677,070

[22] Filed: Apr. 14, 1976

[30] Foreign Application Priority Data

Apr. 19, 1975 [JP] Japan ..... 50/53319

[51] Int. Cl.[2] ..... H01H 19/06

[52] U.S. Cl. ..... 200/302; 200/333

[58] Field of Search ..... 200/42 T, 302, 303, 200/333, 334

[56] References Cited

U.S. PATENT DOCUMENTS

| | | | |
|---|---|---|---|
| 3,163,741 | 12/1964 | Bury | 200/303 X |
| 3,917,921 | 11/1975 | Jakubauskas | 200/333 |
| 3,944,760 | 3/1976 | Zdanys | 200/303 X |
| 3,974,346 | 8/1976 | Keprda | 200/333 |
| 3,978,298 | 8/1976 | Fukuda et al. | 200/333 X |

*Primary Examiner*—J. V. Truhe
*Assistant Examiner*—David A. Tone
*Attorney, Agent, or Firm*—Craig & Antonelli

[57] ABSTRACT

An electrical switch of dual in-line package type which includes a switch casing having a housing fitting over a base onto which contact leads forming switch sections of the switch are molded, actuators movably disposed in the corresponding switching sections for selectively connecting and disconnecting the contact leads, and a dust cover to fit over the housing. Each of the actuators has an actuating knob extending through the housing for moving the actuators between first and second positions to turn the switch section on or off, which actuating knob has notched portions which engage a projection formed in the dust cover for preventing erroneous function of the switch, while the base is initially divided into two blocks for subsequent welding to each other to achieve air-tightness and to facilitate assembling work of the switch.

6 Claims, 13 Drawing Figures

ELECTRICAL SWITCH

Figure 1:
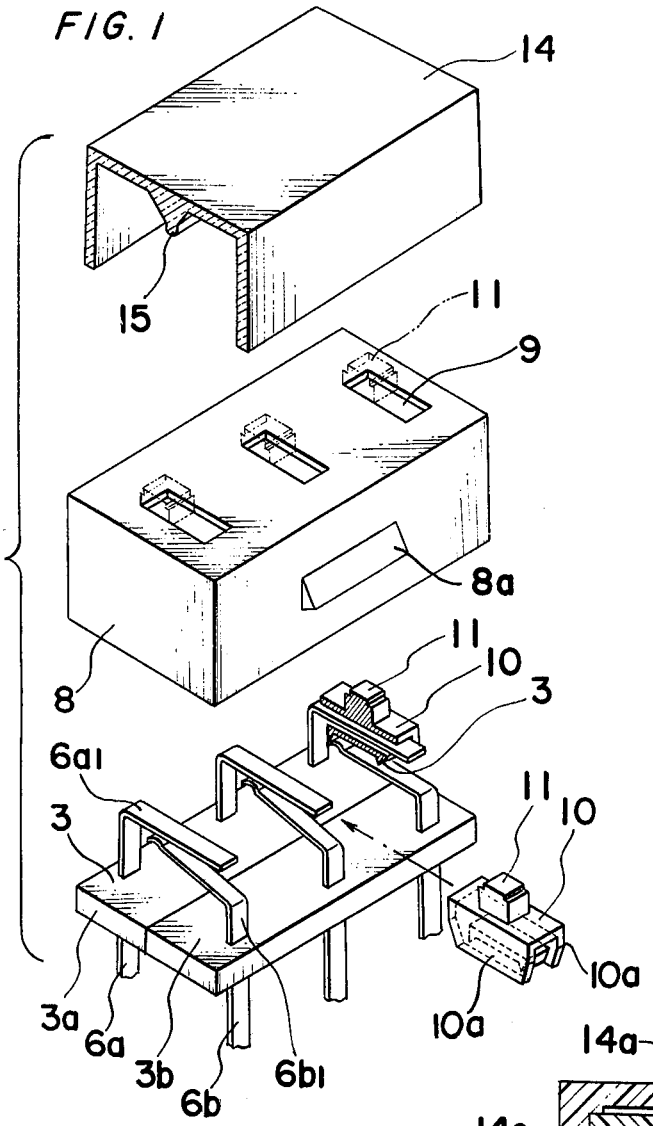

The present invention relates to an electrical switch amd more particularly, to an electrical switch of dual in-line package type for use in an integrated circuit, printed circuit or the like.

Recently, small sized slide switches or toggle switches of dual in-line package type (hereinbelow referred to as DIP type) have come into wide use for incorporation into integrated circuits, printed circuits or the like in the field of electrical and electronic industry.

In the conventional electrical switches of the above described type, it has been a common practice to attach a suitable stopper member onto an actuating member for the switch to prevent erroneous function thereof during use after having set contact points of the switch to ON or OFF position through sliding or rotation of the actuating member to either one of two sides depending on the kind of the switch, which arrangement requiring employment of the stopper member to restrict the sliding or rotation of the actuating member, however, inevitably gives rise to increase in the number of parts for the switch, thus resulting not only in increase of manufacturing cost, but in troublesome handling of such switches in actual use.

Furthermore, in the known multiple switching stage switch of the above described type which is ordinarily produced through insertion of contact leads into corresponding openings formed in rows in a main body of a switch casing, with subsequent sealing of the openings with suitable adhesives for securing the contact leads to the main body, there have been various disadvantages in that when the terminal portions of the contact leads extending outwardly from the main body are soldered, for example, to a base plate of a printed circuit, contact faults at the contact points of the leads tend to take place due to filling up of the casing by the adhesive vaporized by heat during soldering or due to entrance of heated floating impurities resulting from the soldering into the casing through gaps formed in the fused adhesive. Moreover, the insertion of the individual contact leads into the openings of the main body with subsequent fixing thereof through bonding, requires troublesome procedures, thus giving rise to inefficiency in the assembling work of such switches. Additionally, in such prior art multiple-stage switches, for example, of toggle type, a supporting shaft which extends through the actuating members for allowing the same to be rotated thereabout to turn the switch ON or OFF is arranged to be supported by bearing portions integrally formed with the switch casing, which arrangement, however, is very disadvantageous in that the bending operation of the contact leads after such leads having been fixed to the switch casing is considerably hindered due to presence of the bearing portions integrally formed with the switch casing.

On the other hand, in the known switch of the above described type, especially one having a single switching stage construction whose demand has been increasing of late, terminal portions of the contact leads thereof which are to be soldered, for example, to the base plate of the printed circuit tend to lack in rigidity without providing sufficient strength for securing, thus in some cases resulting in breakage or deformation of the terminal portions during switching-over of the contact portions.

Accordingly, an essential object of the present invention is to provide an electrical switch for use in electrical and electronic circuits in which movement of an actuating member of the switch once set to either ON or OFF position is restricted by mere attachment of a dust cover onto the switch casing without requiring any other separate stopping member or the like.

Another important object of the present invention is to provide an electrical switch of the above described type in which a base for the switch casing is divided into two halves, with each half of the two halves being molded over a set of contact leads for subsequent combining through suitable means, with substantial elimination of disadvantages inherent in the conventional electrical switches.

A further object of the present invention is to provide an electrical switch of the above described type which is arranged to be rigidly secured to the applicable circuit with sufficient strength even when the switch has a single switching stage.

A still further object of the present invention is to provide an electrical switch of the above described type whose construction is arranged to facilitate assembling of the switch, with consequent reduction in manufacturing cost.

According to a preferred embodiment of the present invention, a slide switch of dual in-line package type (DIP type) includes a switch casing having a housing fitting over a base to which contact leads forming a plurality of switching sections of the switch are secured, for example, by insert molding, corresponding number of actuating members which are laterally slidably disposed in the switching sections for selectively connecting and disconnecting the contact leads through the sliding movement thereof between first and second positions, and a dust cover which fits over the upper portion of the housing. Each of the actuating members has an actuating knob extending upwardly through an opening formed in the upper portion of the housing for manually displacing the actuating member to either of the first and second positions, which actuating knob is further provided with notched portions at opposite upper side faces for engagement with a projection formed in the inner surface of the dust cover, by which arrangement, the actuating member one displaced to either of the first and second positions for turning the switch section on or off is held in that particular position by the engagement of the notch of the actuating knob with the projection of the dust cover when the dust cover is applied onto the housing, thus possibility of erroneous functioning of the switch is advantageously prevented through simple construction. Furthermore, the base is initially divided into two blocks of resinous material, each molded onto corresponding contact leads for subsequent combining of the two blocks, for example, by ultrasonic welding, thus various disadvantages inherent in the conventional switch construction being eliminated.

Figure 2:
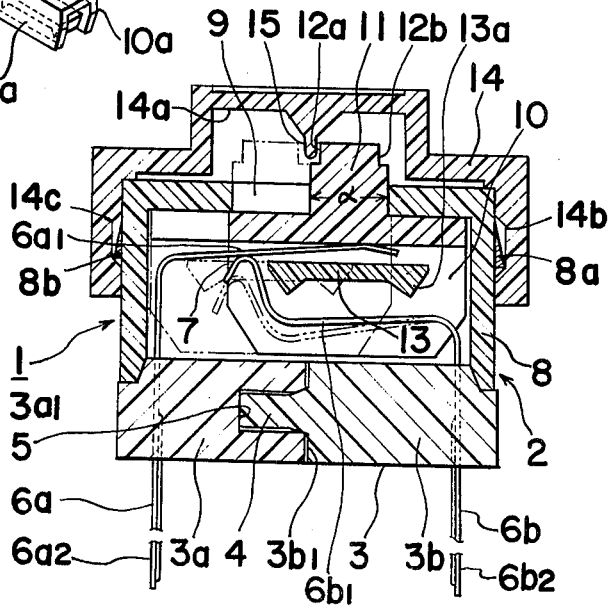
Figure 3:
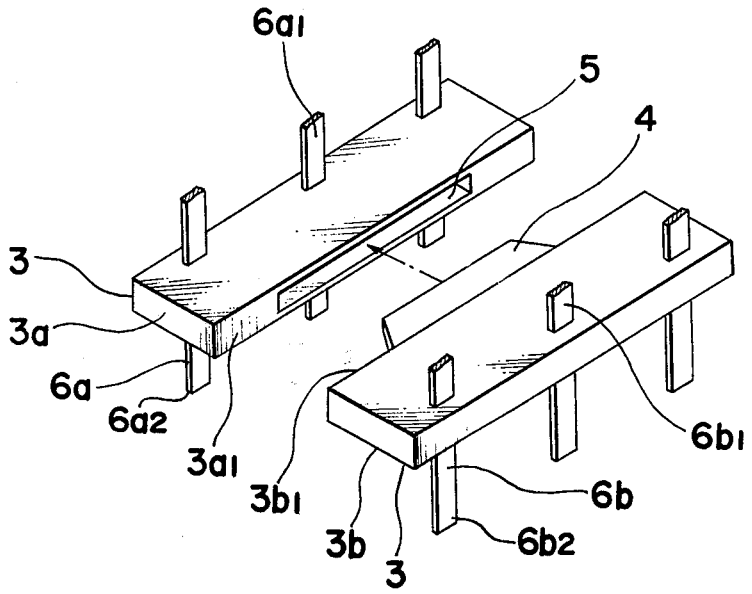
Figure 4:
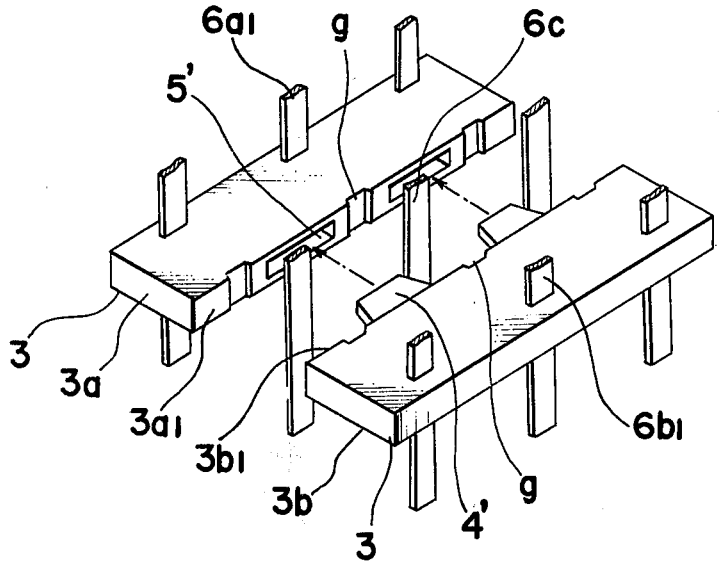
Figure 5:
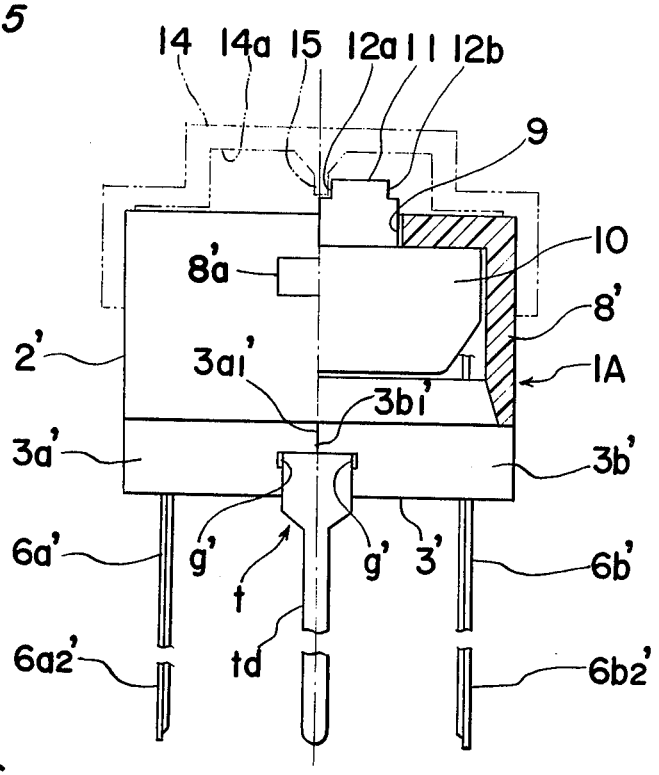
Figure 6:
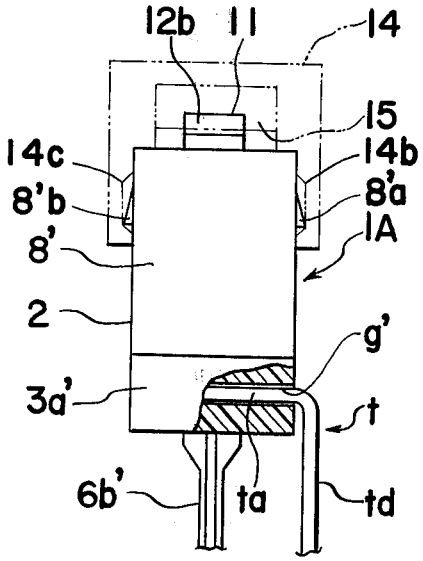
Figure 7:
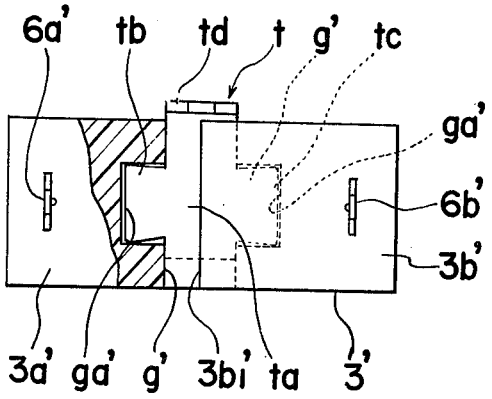
Figure 8:
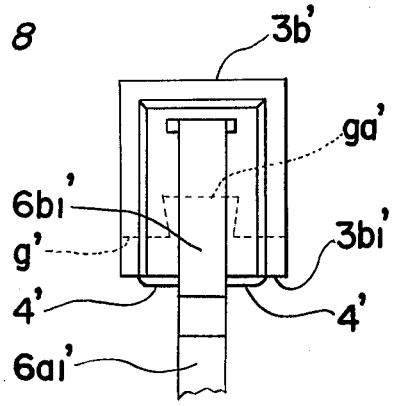
Figure 9:
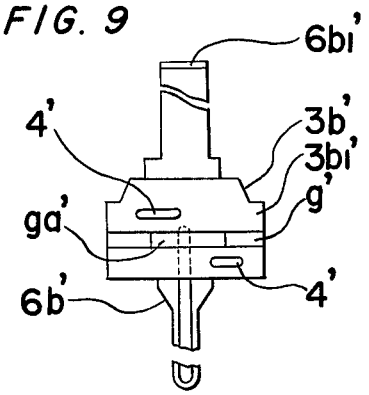
Figure 10:
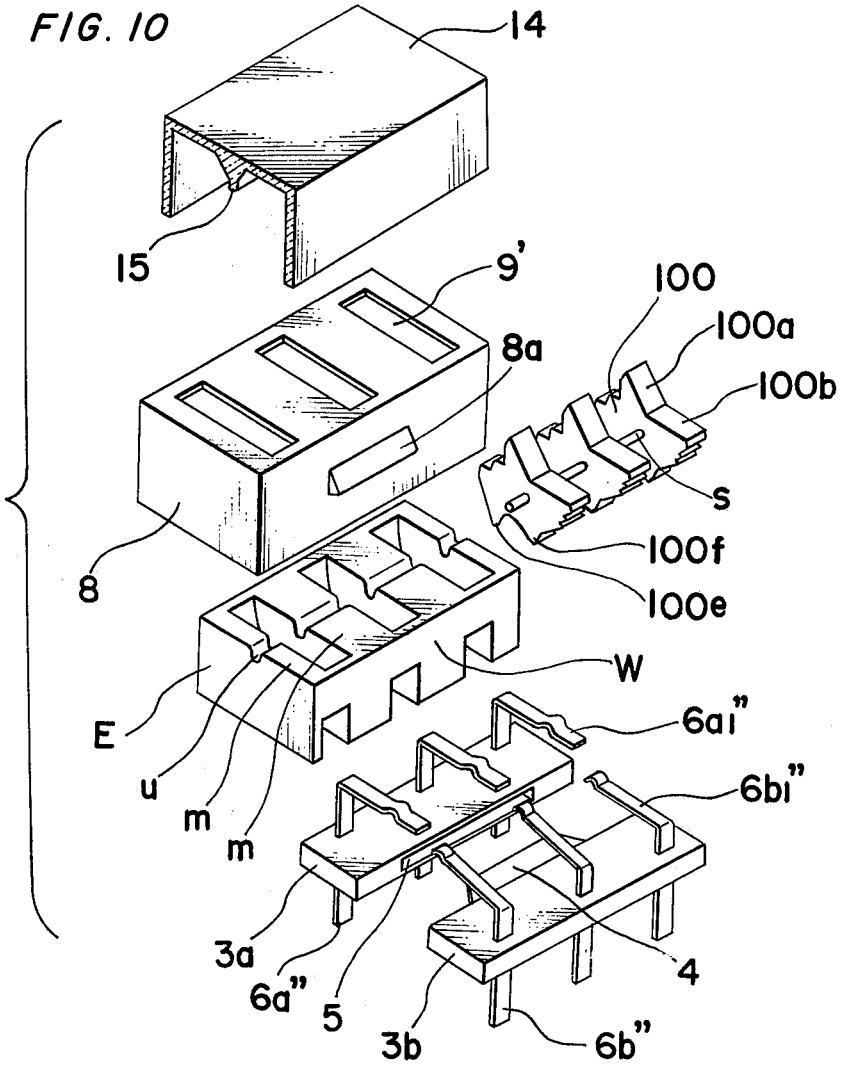
Figure 11:
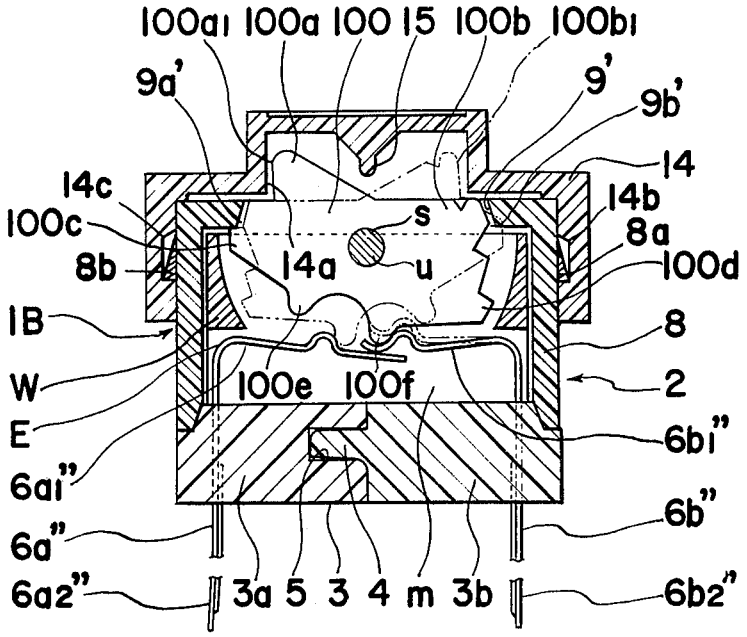
Figure 13:
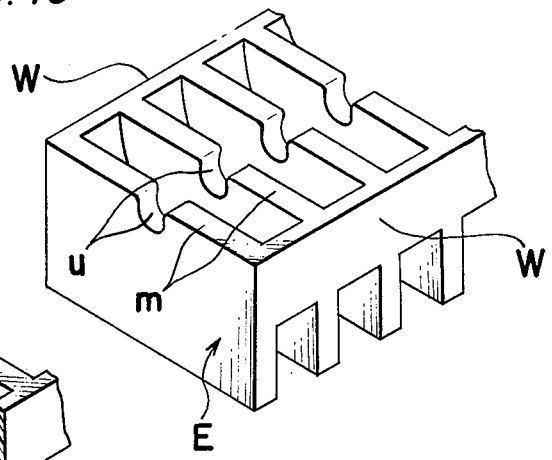
Figure 12:
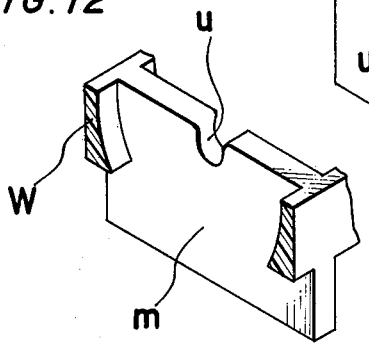

These and other objects and features of the present inventions will become apparent from the following description taken in conjunction with the preferred embodiment thereof with reference to the attached drawings in which;

FIG. 1 is an exploded view of a multiple switching stage electrical slide switch of dual in-line package type according to one embodiment of the present invention, FIG. 2 is a cross sectional front view, on an enlarged scale, of one switch section of the slide switch of FIG. 1, FIG. 3 is an exploded view of a base of the slide switch of FIG. 1, FIG. 4 is a similar view to FIG. 3, but particularly shows a modification thereof, FIG. 5 is a front view, partly in section, of a modification of the slide switch of FIG. 1, FIG. 6 is a side view, partly in section, of the slide switch of FIG. 5, FIG. 7 is a bottom view, partly in section, of the slide switch of FIG. 5, FIG. 8 is a top plan view, showing one block of a base of the slide switch of FIG. 5, FIG. 9 is a front view of the one block of the base of FIG. 8, FIG. 10 is an exploded view of a multiple switching stage electrical toggle switch of dual in-line package type showing a further modification of the switch of FIG. 1, FIG. 11 is a cross sectional front view, on an enlarged scale, of one switch section of the toggle switch of FIG. 10, FIG. 12 is a perspective view showing one partition wall of a casing employed in the switch of FIG. 10, and FIG. 13 is a perspective view showing construction of the casing employed in the switch of FIG. 10.

Before the description of the present invention proceeds, it is to be noted that like parts are designated by like reference numerals throughout several views of the attached drawings.

Referring now to FIGS. 1 to 3, there is shown a multiple switching stage slide switch 1 of DIP type according to one embodiment of the present invention, which slide switch 1 includes a switch casing 2 of rectangular box-like configuration and a dust cover 14 of similar configuration releasably fitted over the upper portion of the casing 2. The switch casing 2 having a plurality of switching sections incorporated therein further comprises a rectangular base 3 and a corresponding housing 8 also fitted over the base 3 to form the casing 2, with the base 3 and the housing 8 being made of electrically insulating resinous material. As is most clearly seen in FIGS. 2 and 3, the base 3 is initially divided longitudinally into two halves or blocks 3*a* and 3*b* on which generally L-shaped electrical contact leads 6*a* and 6*b* are respectively fixed in such a manner that in the preparation of the base 3, the contact leads 6*a* and 6*b* in the form of straight metal strips are arranged in rows along the two halves 3*a* and 3*b* in a longitudinal direction of the latter for being fixed to said two halves 3*a* and 3*b* through insert molding and for subsequent bending of upper portions of the lead 6*a* and 6*b* inwardly so as to form resilient contact portions 6*a*1 and 6*b*1 thereat, with lower portions of the leads 6*a* and 6*b* extending from the base 3 to form terminal ends 6*a*2 and 6*b*2, while a projections 4 formed on a side edge 3*b*1 of the one half 3*b* is thereafter inserted into a recess 5 formed in a corresponding side edge 3*a*1 of the other half 3*a* for combining the two halves 3*a* and 3*b* at the side edges 3*a*1 and 3*b*1 by ultrasonic welding or other securing means to form the single base 3. In each of the switching sections, there is laterally slidably disposed an actuating member 10 of electrically insulating resinous material which also serves as a partition in the longitudinal direction of the contact portions 6*a*1 and 6*b*1. The actuating member 10 of U-shaped cross section having a pair of spaced side walls 10*a* for accommodating the contact portions 6*a*1 and 6*b*1 therebetween is further provided with an actuating knob 11 which extends upwardly through an opening 9 formed in the top wall of the housing 8 and having width twice that of the knob 11 to permit the lateral movement of the same knob 11, with the knob 11 further formed with notches 12*a* and 12*b* at opposite upper edges thereof, while a pressing member 13 having downward projections 13*a* at opposite edges thereof extends from one of the side walls 10*a* in a direction normal to the other of the side walls 10*a* at a position spaced from the upper wall of the actuating member 10 to allow insertion of the contact portion 6*a*1 therebetween as shown. Accordingly, the contact portions 6*a*1 and 6*b*1 of the leads 6*a* and 6*b* are selectively brought into contact with and spaced from each other to ON and OFF positions through lateral sliding movement of the actuating member 10 by a finger and the like. More specifically, when the actuating member 10 is located at the leftmost position as shown by a chain line in FIG. 2, one of the projections 13*a* of the pressing member 13 depresses an upwardly curved portion 7 of the contact portion 6*b*1 so as to space the latter from the contact portion 6*a*1 toward the OFF position as shown, while, upon movement of the actuating member 10 to the rightmost position shown by a real line in FIG. 2, the contact portion 6*a*1 is released from the depression by the pressing member 13 so as to be permitted to rise by its resilience and contact the contact portion 6*a*1 of the lead 6*a* for tuning ON the section of the switch 1. It should be noted here that the distance through which the knob 11 of the actuating member 10 travels within the opening 9 of the housing 8 is equal to the width $\alpha$ of the knob 11.

On the other hand, the dust cover 14 detachably fitted over the housing 2 for covering the actuating members 10 has a projection 15 extending downwardly from a central portion of a top wall 14*a* thereof and in a longitudinal direction of the same cover 14, the lower edge of which projection 15 is engageable with the notches 12*a* and 12*b* of the actuating knob 11 displaced to either of the ON and OFF positions.

It is to be noted that the dust cover 14 as described above and as shown in the drawing 5, is preferably formed in a symmetrical shape so that the configuration thereof is simple while facilitating the manufacturing steps. Furthermore, it is readily apparent that such a symmetrical shape simplifies the manufacturing steps of the electrical switches since it is not necessary to distinguish the direction for placing the dust cover 14 over the housing 2.

The connection between the dust cover 14 and the housing 2 can be effected by a suitable engaging means which is described hereinbelow, in connection with FIGS. 2, 6, and 11. The housing 8, 8′ is provided with slanted projections, namely claws 8*a*, 8′*a* and 8*b*, 8′*b* on the outer surface of the opposite side walls, respectively, and the dust cover 14 is provided with corresponding recesses, namely detent recesses 14*b* and 14*c*, formed in the inner surface of the opposite side walls, so that the detent recesses 14*b* and 14*c* of the dust cover 14, when the cover 14 is placed over the housing 2, are tightly fitted over the claws 8*a* and 8*b*, as shown in FIGS. 2 and 11, or 8′*a* and 8′*b*, as shown in FIG. 6, to rigidly maintain the dust cover 14 in position over the housing 8 or 8′.

For incorporation of the above discribed slide switch 1, for example, into an integrated circuit, printed circuit or the like, the actuating members 10 are each slid laterally in either of the two directions to bring the contact portions 6a1 and 6b1 into the ON and OFF position according to predetermined connecting relation to the circuit, with subsequent attaching of the dust cover 14 onto the housing 8. Thereafter, the terminal ends 6a2 and 6b2 extending downwardly from the base 3 are connected to predetermined positions in the circuit, for example, by soldering, in which case, since the notches 12a and 12b of the knob 11 engage the projection 15 of the dust cover 14 for restricting sliding movement of the actuating member 10, malfunction of the contact portions 6a1 and 6b2 of the leads 6a and 6b is advantageously eliminated.

It should be noted here that the notches 12a and 12b described as formed in the knob 11 in the above embodiment many be dispensed with so as to utilize the opposite side faces of the knob 11 for the similar purpose, in which case, construction of the actuating member 10 is further simplified.

As is clear from the foregoing description, according to the slide switch of the invention, the dust cover is provided with the downward projection to prevent the sliding movement of the actuating members, so that the actuating members once set to either of the ON and OFF positions are perfectly restricted for any sliding movement through mere fitting of the dust cover over the upper portion of the switch casing, which arrangement, not only facilitates the handling of the switch, but reduces the number of components for the switch through absence of any stopper member or the like, thus slide switches with accurate functioning and simple construction being presented at low manufacturing cost.

It should be noted here that the concept of the present invention is not limited, in its application, to the switch of DIP type as described above, but may be applicable to any other switches wherein the contact portions thereof are actuated by slidable actuating members.

Furthermore, in the slide switch of FIGS. 1 to 3, since the contact leads 6a and 6b are respectively fixed to the two halves or blocks 3a and 3b of the base 3 through the insert molding of resinous material, perfectly air tight connection between the leads 6a and 6b and the two halves 3a and 3b is available without employment of any adhesives, thus deterioration of the contact portions 6a1 and 6b1 due to vaporized adhesives and reduction of air tightness through fusion of the adhesives arising from heat in soldering the terminal ends 6a2 and 6b2, for example, to the print circuit base plate (not shown) being advantageously eliminated. Moreover, the corresponding side edges 3a1 and 3b1 of the base 3 which are welded together or fusionbonded to each other, for example, through the ultrasonic welding has perfect air tightness, thus entrance of floating impurities or harmful gas from the fused adhesives into the housing 8 being completely prevented, with the contact portions 6a1 and 6b1 being consequently free from contact faults. Additionally, since the leads 6a and 6b are respectively molded into the two halves 3a and 3b of the base 3, efficiency of assembling work of the switch is improved to an appreciable extent as compared with that in assembling work employing adhesives.

Referring to FIG. 4, there is shown a modification of the base 3 of FIG. 3, in which modification, the side edge 3b1 of the one half 3b of the base 3 is formed with a plurality of projections 4' which fit into corresponding number of recesses 5' formed in the side edge 3a1 of the other half 3a of the base 3, while grooves *g* are formed in the side edges 3a1 and 3b1 in positions adjacent to opposite ends and also between the projections 4' and the recessess 5' of the two halves 3a and 3b for holding third contact leads 6c which are to be bent suitably between the side edges of the two halves 3a and 3b when the same halves are welded together in the manner as described earlier, thus the base plate 3 which has the contact leads 6a, 6b and 6c aligned in three rows for selective engagement and disengagement therebetween being obtained, in which arrangement also, exactly the same effect of preventing the contact faults and facilitating the assembling work as in the embodiment of FIG. 3 can be presented through the division of the base 3 into the two halves 3a and 3b.

Referring now to FIGS. 5 to 9 there is shown another modification of the slide switch of FIG. 1. In this modification, a slide switch 1A employs a single switching stage, and the projection 4 and the recess 5 described as formed in the corresponding side edges 3a1 and 3b1 of the base 3 are replaced by a plurality of small projections 4'' (FIGS. 8 and 9) and corresponding recesses (not shown) formed on correspondign side edges 3a1' and 3b1' of two halves 3a' and 3b' of the base 3', while grooves *g'* are formed at central portions of the same side edges 3a1' and 3b1' in positions spaced from the small projections 4'' and the corresponding recesses (not shown) formed therein, which grooves *g'* extending along the side edges 3a1' and 3b1' in directions parallel to the surfaces of the base 3' are further provided in the central portions of the two halves 3a' and 3b' with recesses *ga'* thus forming a cross-shaped space within the base 3' when the two halves 3a' and 3b' are combined at the side edges 3a1' and 3b1' thereof. An auxiliary fixing terminal strip *t* of approximately L-shape which is made of somewhat thick metallic material and which has a base portion *ta* of cross-shape corresponding to the cross-shaped space in the base 3', and a leg portion *td* extending at right angles from the base portion *ta* is inserted at the base portion *ta* into the grooves *g'* of the divided two halves 3a' and 3b' of the base 3', with the projecting portions *tb* and *tc* which are integrally formed with the base portion *ta* being fitted into the recesses *ga'* of the grooves *g'*, after which the side edges 3a1' and 3b1' of the two halves 3a' and 3b' are combined through insertion of the small projections 4'' of the one half 3b' into the corresponding recesses of the other half 3a' for being welded together, for example, by the ultrasonic welding to form the single base 3', thus the fixing terminal strip *t* being rigidly held between the two halves 3a' and 3b' with the leg portion *td* thereof extending downwardly from the base 3' as shown.

For securing the above described slide switch 1A, for example, onto an integrated circuit, printed circuit or the like, the actuating member 10 is slid laterally in either of the two directions in the similar manner as in the slide switch 1 of FIG. 1 to bring the contact portion 6a1' and 6b1' (FIG. 8) of exactly the same construction as the contact portion 6a1 and 6b1 of FIG. 1 to ON or OFF position according to predetermined connecting relation with respect to the applicable circuit, with subsequent attaching of the dust cover 14 onto the housing 8'. Thereafter, the terminal ends 6a2' and 6b2' of the contact leads 6a' and 6b' extending from the base 3' are connected to predetermined positions in the circuit, for example, by soldering, while the leg portion *td* of the fixing terminal strip *t* is secured to the base plate or substrate of the circuit also by soldering or by securing screws (not shown), by which arrangement, the slide switch 1A is rigidly fixed to the base plate at its fixing terminal *td* with sufficient strength.

Other construction and effect of the slide switch 1A of FIGS. 5 to 9 are exactly the same as those in the slide switch 1 of FIGS. 1 to 3, so that detailed description thereof is abbreviated for brevity.

It should be noted here that the fixing terminal strip *td* of the above described switch 1A described as fitted into the cross-shaped space in the base 3' at the base portion *ta* thereof may be replaced by another fixing terminal strip arranged to extend at the upper portion thereof into the housing 8', in which case, the upper portion of such a fixing terminal strip can be utilized as a common terminal within the housing 8'.

It should also be noted that the concept of the above described slide switch of the invention is not limited, in its application, to the slide switch 1A, but may be applicable to other types of switch, for example, a toggle type switch wherein the contact portions are adapted to be turned ON or OFF through movement of a pressing actuating member rotatable within a predetermined angle.

As is seen from the foregoing description, according to the slide switch 1A of the invention, since the fixing terminal strip *t* separate from the terminal ends 6a2' and 6b2' is provided in the base 3', the slide switch is rigidly secured through said terminal strip *t* to the base plate of the circuit with sufficient strength, which arrangement is particularly effective for use in a switch having a single switching stage whose terminal ends are not sufficiently strong for rigidly supporting the switch on the base plate of the applied circuit. The arrangement that the base 3' initially divided into two blocks is subsequently welded to each other by fusion-bonding is also advantageous in the slide switch 1A of FIGS. 5 to 9, since possibility of disengagement at the welded joint is negligible as compared with the conventional construction wherein adhesives are employed for bonding.

Referring now to FIG. 10, there is shown a further modification of the switch of FIG. 1. In the switch 1B of the modification, the actuating members 10 of sliding type described as employed in the switch 1 of FIG. 1 are replaced by push-type actuating members 100 of known configuration rotatably mounted on a shaft S at regular intervals corresponding to the multiple-switching sections of the switch 1B which are separated by a spacer member E of resinous material mentioned below. The spacer member E of generally rectangular cubic configuration fitting into the housing 8 of the switching casing 2 includes a plurality of partition walls *m* which are spaced at regular intervals for accommodating therebetween the actuating members 100 and the contact portions 6a1'' and 6b1'' of the contact leads 6a'' and 6b'', and which are connected with each other at upper portions of opposite side edges thereof by side walls *w*, with a recess *u* being formed in the central portion of upper edge of each partition wall *m* for receiving therein the shaft S of the actuating members 100 so as to permit pivotal movement of the members 100 about the shaft *s*. The pivotal movement or rotation of the actuating member 100 is arranged to be restricted by the contact of the projection 100c or 100d (FIG. 11) of the member 100 with a corresponding peripheral edge 9a' or 9b' of the opening 9' which is formed in the top wall of the housing 8 and through which actuating knob 100a or 100b of the member 100 extends for selective depression to cause connection and disconnection between the contact portions 6a1'' and 6b1'' and consequently to turn the switch section ON and OFF. More specifically, the actuating member 100 is rotated by selective depression of the pressing portions 100a and 100b of the member 100, for example, by a finger or other objects having pointed tips, and in the state where the portion 100b is depressed as shown by a real line in FIG. 11, an actuating projection 100f formed at the lower portion of the member 100 depresses a curved front end of the contact portion 6b1'' as shown for engagement of the portion 6b1'' with the corresponding contact portion 6a1'' to turn on the switch, while upon depression of the pressing portion 100a as shown by a chain line in FIG. 11, the contact portion 6b1'' is released from the depression by the projection 100f, with another actuating projection 100e which is also formed at the lower portion of the actuating member 100 depressing the front end of the contact portion 6a1'' for spacing the same portion 6a1'' from the contact portion 6b1'' to turn OFF the switch section.

During assembling of the above described switch 1B of toggle type, the spacer member E is first placed on the base 3 so that the pairs of the contact portions 6a1'' and 6b1'' are separated from each other by the partition walls *m*, with the shaft *s* of the actuating members 100 being received by the recesses *u* of the walls *m*. Subsequently, the housing 8 is placed over the spacer member E for engagement, by suitable means, with the base 3, with the dust cover 14 of exactly the same construction as that in the embodiment of FIG. 1 being attached onto the upper portion of the housing 8. It should be noted here that the spacer member E is held in position between the housing 8 and the base 3 which are connected to each other in the manner as described above.

For incorporating the above described switch 1B, for example, into an integrated circuit, printed circuit or the like, the actuating members 100 are each rotated in either of the two directions for bringing the contact portions 6a1'' and 6b1'' into the ON or OFF position according to connecting relation with respect to the applicable circuit, with subsequent placing of the dust cover 14 onto the housing 8. Thereafter, the terminal ends 6a2'' and 6b2'' extending downwardly from the base 3 are connected to predetermined positions in the circuit by suitable means, for example, by soldering. Upon placing the dust cover 14 onto the upper portion of the housing 8, any further rotation of the actuating members 100 once set to either of the two sides is positively prevented to avoid erroneous function, by the contact of the surface 100a1 or 100b1 (FIG. 11) of notched portion formed at an outer edge of the actuating knob 100a and 100b with other of corresponding inner side faces 14a of the dust cover 14.

It should be noted that the dust cover 14 employed in the switch 1B of FIG. 10 has exactly the same construction as that described with reference to the slide switch 1 of FIG. 1, and that the presence of the projection 15 in the inner top wall of the cover 14 presents no obstruction in the case of the toggle type switch 1B of FIG. 10. Furthermore, the dust cover has at least the top portion thereof formed by a transparent plate member, thereby enabling the position of the switch to be observed without removal thereof.

As is clear from the foregoing description, according to the switch 1B of FIG. 10, since the spacer member E is provided separately from the switch casing 2 for supporting thereby the shaft *s* of the actuating members 100, the disadvantages inherent in the conventional arrangement such as obstruction to efficient work due to the presence of the actuator shaft during securing of the contact leads to the switch casing through insert molding or bending the same leads to form the contact portions are advantageously eliminated, thus manufacturing of such switches being much facilitated. Furthermore, the arrangement wherein the switch casing 2 is divided into the housing 8 and the base 3, with the base 3 being divided into two halves 3*a* and 3*b* detailed with reference to the embodiment of FIGS. 1 to 4, further facilitates fixing of the contact leads 6*a*'' and 6*b*'' to the base 3 and the bending of the contact leads 6*a*'' and 6*b*'' to form the contact portions 6*a*1'' and 6*b*1''.

Since other construction and function of the switch 1B of FIG. 10 are similar to those in the switch 1 of FIG. 1, detailed description thereof is abbreviated for brevity.

It should be noted here that the concept of the above described switch of the invention is not limited, in its application, to the toggle switch 1B of DIP type, but may be applicable to any other types of switches wherein the contact portions are adapted to be actuated by rotation of the actuating members of pressing type.

It should also be noted that a toggle switch of the above described type employing a single switching section and having sufficient strength when secured to the applicable circuit may be readily formed by the employment of the fixing terminal strip *t* and associated arrangement as described with reference to the switch 1A of FIGS. 5 to 9.

It is needless to say that the concept of the present invention is not limited, in its application, to the small sized switches of DIP type as detailed in the foregoing description, but may readily be applicable to large sized switches of similar types depending on the necessity.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An electrical switch of a dual-in-line package type connectable to a substrate having a plurality of switch units each movably provided to be positioned between an operative position and inoperative positions, said switch units being aligned in parallel relation to each other, said electrical switch comprising:

a base plate member;

a plurality of pairs of contact lead members supported by said base plate member, each of said contact lead members having one end portion thereof extending outwardly from one surface of said base plate member for effecting external connection of said lead member, and another end portion of said contact lead member extending from another surface of said base plate member and having an L-shaped configuration with a free end directed toward the other lead of said pair of lead members for effecting interconnection of said pair of lead members during the presence of said switch unit in said operative position;

an actuator member having two pressing portions, said actuator member rotatably mounted above said pair of contact lead members to move between a first position causing said other end portion of said pair of contact lead members to be interconnected with each other by pressing one of said two pressing portions, and a second position wherein said other end portion of said pair of contact lead members are disconnected from each other by pressing the other of said pressing portions a housing fitted over said base plate member to enclose said contact lead members within said housing, said housing having an elongated opening formed on a top portion thereof for receiving therethrough said pressing portions; and a cover member provided over said housing, said cover member having opposite edge portions provided on an inner surface of a top wall thereof, said opposite edge portions being engageable with an edge of said pressing portions, so as to prevent said actuator member from being moved from a predetermined position thereof.

2. An electrical switch as claimed in claim 1, further comprising auxiliary leg members having one end portion thereof fixedly provided in said base plate member and another end portion thereof being extended from said one surface of said base plate member for rigidly supporting said base plate member on said substrate.

3. An electrical switch as claimed in claim 1, wherein said cover member is formed in a symmetrical shape.

4. An electrical switch as claimed in claim 1, further comprising a spacer member fitted between said base plate member and said housing for rotatably supporting said actuating member.

5. An electrical switch as claimed in claim 1, wherein said cover member has at least the top portion thereof formed by a transparent plate member.

6. An electrical switch as claimed in claim 1, wherein said housing has at least one claw formed on an outer surface of a side wall thereof for tightly engaging said claw with a detent recess formed on an inner surface of side wall of said cover member.

* * * * *